US006180933B1

(12) United States Patent
Demidovitch et al.

(10) Patent No.: US 6,180,933 B1
(45) Date of Patent: Jan. 30, 2001

(54) FURNACE WITH MULTIPLE ELECTRIC INDUCTION HEATING SECTIONS PARTICULARLY FOR USE IN GALVANIZING LINE

(75) Inventors: Victor B. Demidovitch, Pittsburgh; William Goodlin, McMurray, both of PA (US)

(73) Assignee: Bricmont, Inc., Cannonsburg, PA (US)

( * ) Notice: Under 35 U.S.C. 154(b), the term of this patent shall be extended for 0 days.

(21) Appl. No.: 09/498,394

(22) Filed: Feb. 3, 2000

(51) Int. Cl.[7] ..... H05B 6/16

(52) U.S. Cl. ..... 219/655; 219/645; 219/656; 219/662

(58) Field of Search ..... 219/635, 645, 219/647, 653, 655, 656, 657, 660, 662–665

(56) References Cited

U.S. PATENT DOCUMENTS 4,239,483 12/1980 Iida et al. .
4,289,944 * 9/1981 Reese ..... 219/645
4,321,444 * 3/1982 Davies ..... 219/645
5,487,795 * 1/1996 Kim et al. ..... 219/656
5,770,838 * 6/1998 Rohrbaugh et al. ..... 219/645

FOREIGN PATENT DOCUMENTS 57-19336 2/1982 (JP) .
57-94524 6/1982 (JP) .

* cited by examiner

*Primary Examiner*—Tu Ba Hoang
(74) *Attorney, Agent, or Firm*—Clifford A. Poff

(57) ABSTRACT

A furnace for heating ferrous metal workpiece is made up of a plurality of pairs of furnace sections with each pair of furnace section having a longitudinal flux inductors with controls for rapidly adjusting the heating rate according to a desired workpiece discharged temperature from the second of the furnace sections. The second furnace is controlled to maintain a substantially constant workpiece heating temperature. A second pair of furnace sections is provided with a first furnace section utilizing coil pairs with a dual output power supply having independent phase adjustable output currents to vary the current phase relation between the coils between 0 and 180°. The change to the phase relation is used to maintain efficient heating of the metal strip above the Curie temperature.

40 Claims, 7 Drawing Sheets

FURNACE WITH MULTIPLE ELECTRIC INDUCTION HEATING SECTIONS PARTICULARLY FOR USE IN GALVANIZING LINE

CROSS-REFERENCE TO RELATED APPLICATIONS

Not applicable.

BACKGROUND OF THE INVENTION

1. Field of the Invention

The present invention relates to a furnace having sequentially arranged furnace sections including strategically located electric induction heating sections to heat ferrous workpieces to a predetermined furnace discharge temperature without workpiece losses due to changes to required heating rates arising out of changing dimensions and metallurgical composition of the workpieces, and, more particularly, to a method and apparatus for initial heating of ferrous metal workpieces by a rapidly responsive induction heating furnace section to supply heated workpieces at selected temperatures for heating in a constant temperature chamber of a sequential furnace section to produce a predetermined workpiece discharge temperature and for additional heating of the workpieces by a further rapidly responsive induction heating furnace section to a controllable discharge temperature without adverse limitations due to changing magnetic properties at Curie temperatures of the workpieces and for further heating in a constant temperature chamber by a fourth sequentially arranged furnace section for attaining a final furnace discharge temperature suitable for cleaning, annealing or other purposes requiring heating of the workpieces and/or the supply of heated workpieces for further processing particulary galvanizing.

2. Description of Related Art

Furnaces comprising multiple furnace sections are known in the art for heating elongated ferrous metal workpieces having any of diverse cross-sectional shapes and passed in a generally continuous fashion in the furnace in an end-to-end relationship. Examples of such ferrous metal workpieces are wire, bar stock, structural shapes, plates, rails and strip. While not so limited, the present invention is particularly useful for the heating of ferrous metal workpieces known in the steel making industry as steel strip. Steel strip in a coil has a substantially uniform end to end thickness and when supplied from a hot strip rolling mill installation is in a coiled form having a strip thickness in a thickness range of, for example, 0.50 to 0.025 inch, and when supplied from a cold rolling mill installation is in coiled form having a strip thickness in a thickness range of, for example, 0.07 to 0.006 inch. These ranges of strip thicknesses are only generalizations and should be expected to vary considerably when comparing specific steel making facilities.

A significant portion of strip production is lost because of the inability to maintain the quality of the heat treating cycles during a transition from one strip gauge or thermal cycle to another strip gauge or thermal cycle. In a steel making facility, it is important to utilize heat treating equipment embodying a design and capacity to rapidly adjust the heat treating parameters to meet the need for changing from one strip gauge or thermal cycle to another without significant losses due to a non prime strip product. Such losses are of less concern in a continuous annealing process, for example, where extensive production with strip having the same or similar metallurgical properties dominate the product mix. However, the more frequent and drastic changes to the strip thickness and metallurgical properties as needed, for example, to fulfill the sales of small strip tonnage usually required the use of batch annealing operations to remain cost effective however batch annealing operations are time consuming when compared with the speed at which annealing can be accomplished in a continuous annealing line. This is especially important when the annealing operation is part of the hot dipped galvanizing process used to adhere a protective coating of zinc and zinc compounds on the surface of the strip product. The heat treating process for the strip generally requires heating the strip to a temperature greater than the strip entry temperature into a bath of molten zinc for the galvanizing process. The heat treatment is usually necessary not only to clean the strip of mill scale, oil and other surface contaminants, but also to heat the strip to a much higher temperature for annealing because the strip supplied from a hot or cold rolling mill operation in a metallurgically hard condition which is usually not a desired property of galvanized strip.

When the metal workpiece is a carbon steel strip and the annealing furnace is used in a galvanizing process line, three hardness grades of the strip products are generally produced namely: full hard; commercial quality; and drawing quality. For a metallurgically full hard strip product, the hardness of the strip as received from the hot strip mill or the cold rolling mill is not significantly changed because of the low temperate excursion in the heat treating process. The nominal furnace exit temperature is in the range of 1000° F. to 1020° F. For a strip hardness of commercial quality, the strip is heated to a nominal furnace exit temperature in the range of between 1345° F. and 1400° F. For strip hardness of drawing quality, the strip is heated to a nominal furnace exit temperature in the range of between 1540° F. and 1600° F.

A continuous annealing furnace is typically made up of three furnace sections operating within limited variations to the furnace heating capacity when the steel product to be annealed does not significantly change. If a significant change to the product did occur then either a line speed change or a change to the average specific heating values by either the cleaning or soaking furnace sections will be needed due to interrelated optimum process parameters which were part of the design an operation of these furnace sections. In a heat treatment process for a commercial strip, the optimum cleaning requires heating the strip to a temperature of 1150° F. which can be achieved as a strip exit temperature from a first furnace section. Since the Curie temperature for carbon steel is about 1325° F., depending on constitute alloys the second furnace section must heat the metal strip to a temperature above the Curie temperature for the strip to produce a drawing quality product. When the second furnace section has the form of an electric induction furnace, longitudinal flux inductors can be used to achieve high efficiency heating of the carbon steel strip to a temperature below the Curie temperature. The third furnace section is typically used for heat soaking the strip with a relatively small temperature increase.

An example of a multiple furnace section known in the art is found in Japanese Patent Publication 57-19336 laid open Feb. 1, 1982, entitled Continuous Annealing Furnace Having Induction Heating Section and provides an arrangement of furnace sections made up of an induction heating zone between an upstream gas heating zone and a downstream soaking zone. Downstream of this furnace arrangement there is an induction reheat zone between an upstream gas reheat zone and a downstream slow cooling zone. This annealing furnace arrangement suffers from the disadvantage that the strip is initially heated in each arrangement of furnace sections by gas heating zones which cannot be controlled to respond to different required heating rates for strip that changes from coil-to-coil. Japanese Patent Publication 55-170276 laid open Dec. 4, 1980 entitled Continuous Annealing Method discloses the temporary use of induction heaters having high heating rates in the heating zone and/or soaking zone for changing heating cycles and after the heating cycle has been adjusted, the strip speed is altered to eliminate the need to use the induction heaters.

U.S. Pat. No. 4,239,483 discloses a continuous annealing facility with a preheat zone divided into units each having nozzles that can be turned ON and OFF to selectively direct high speed heating gas against the strip. During a transition between strips of different thicknesses, the temperature in the preheat zone is controlled by the number of gas injecting preheating units in operation. Downstream of the preheat zone is a rapid heating zone. The temperature in the rapid heating zone changes to a preset value based upon the thickness of the strip in the line.

It is an object of the present invention to provide a furnace and a method for heating ferrous workpieces to minimize off prime heat treatment by a unique placement of at least two induction heating furnaces each followed by an additional furnace section to alter heating of workpieces rapidly that enter the furnace in a continuous end to end relationship for heating each workpiece according to predetermined heating requirements.

It is another object of the present invention to provide an electric induction heating furnace section having at least one induction coil pair supplied with electrical power for heating elongated ferrous workpieces selectively by a transverse magnetic flux field or a longitudinal magnetic flux field depending on the Curie temperature by a furnace having a plurality of additional furnace sections.

It is a further object of the present invention to provide a plurality of pair of sequential furnace sections and a method for heating ferrous workpieces fed in an end-to-end relationship with the first furnace section of each pair being rapidly adjustably controlled to heat a workpiece in response to a desired delivery temperature for the workpiece delivered from the second of that pair of furnace sections.

It is still a further object of the present invention to provide a heat furnace for workpiece in a galvanizing line in which the workpieces are selectively heated to a temperature above or below the Curie temperature by selecting a phase relation to current applied to an electrical inductor coil pair.

It is another object of the present invention to provide an annealing furnace with multiple electric induction heating sections that will continuously heat any combination of varying product grades with minimum transition material loss between changes in grades.

BRIEF SUMMARY OF THE INVENTION

According to the present invention there is provided a furnace for heating ferrous metal workpieces, the furnace including the combination of a plurality of furnace sections including sequential first, second, third, and fourth furnace sections for heating ferrous metal workpieces arranged in an end to end relation to form a continuous supply of workpieces, some of the workpieces requiring heating rates differing from workpiece to workpiece for heating to a desired furnace discharge temperature, a first adjustable furnace controller to control the first furnace section for heating a preselected one of the workpieces at a heating rate different from a heating rate for another the workpieces forming the continuous supply of workpieces for discharge from the first furnace section at correspondingly different workpiece temperatures, a second furnace heating control for the second furnace section to maintain a second furnace operating temperature sufficiently constant to further heat the workpieces to a predetermined required discharge temperature, a third adjustable furnace controller to control the third furnace section for continued heating of the workpieces, the adjustable furnace controller controlling heating of the preselected one of the workpieces at a heating rate different from a heating rate for other of the workpieces for discharge from the third furnace section at correspondingly different workpiece temperatures, and a fourth furnace heating control operatively coupled to the fourth furnace section for maintaining a fourth furnace operating temperature to continue heating of the workpieces including the preselected one of the workpieces for discharge from the fourth furnace section at a predetermined temperature to metallurgically heat treat the continuous supply of workpieces.

According to another aspect of the present invention there is provided a furnace including the combination of a plurality of furnace sections for sequential heating elongated ferrous workpieces feed in an end-to-end relation to form a continuous supply of the workpieces, the furnace sections including an electric induction heating furnace section having at least one induction coil pair for electric induction heating of the workpieces, and an electric power source including a controller to adjust an electrical phase relationship between currents applied to the coil pair of the at least one inductor coil pair in the range between an in phase relationship for heating the workpieces by transverse magnetic flux with respect to the direction of travel of the workpieces to temperatures exceeding the Curie temperatures of the workpieces and an out of phase relationship for heating in longitudinal magnetic flux with respect to the direction of if travel of the workpieces to temperatures below the Curie temperatures of the workpieces.

The present invention also provides a method for heating ferrous workpieces, the method including the steps of feeding discrete ferrous workpieces in an end-to-end relation to form a continuous supply of ferrous workpieces, some of the ferrous workpieces having heating rates differing from workpiece to workpiece for heating to a predetermined desired furnace discharge temperature, continuously heating the ferrous workpieces in sequential first, second, third and fourth furnace sections, controlling the second furnace and the fourth furnace section to heat the ferrous workpieces at discrete and substantially constant heating rates, rapidly adjusting a heating rate by the first furnace section according to the differing required heating rates to continually discharge the continuous supply of ferrous workpieces from the second heating furnace at a predetermined required discharge temperature, and rapidly adjusting a heating rate by the third furnace section according to the differing required heating rates to continually discharge the continuous supply of ferrous workpieces from the fourth heating furnace at a predetermined required discharge temperature.

In another form, the present invention provides a method for supplying heated ferrous workpieces for galvanizing, the method including the steps of providing sequential first, second, third and fourth furnace sections having separate furnace controls for heating lengths of elongated ferrous workpieces passed in succession in an end to end relation in each furnace section, the first and third furnace sections each having at least one inductor coil pair for heating the ferrous workpieces, controlling each of the second and fourth furnace sections to provide substantially constant furnace operating temperatures for heating a length of the ferrous workpieces when resident therein, controlling current applied to the electrical inductor coil pair of the first furnace section to provide a substantially constant exit temperature for the ferrous workpieces at the exit of the second furnace section, controlling current applied to the electrical inductor coil pair of the third furnace section to provide a substantially constant exit temperature for the ferrous workpieces at the exit of the fourth furnace section, the control of the current applied to the electrical inductor coil pair of the third furnace section being variable from an in phase relation for the applied current to the coil pair at temperatures above the Curie temperatures and an out of phase relation for applied current to the coil pair at temperatures below the Curie temperatures to heat the ferrous workpieces independently of the Curie temperatures, and cooling the ferrous workpieces discharged from the fourth furnace section to a predetermined temperature for the application of galvanizing.

In a particular form the present invention provides a method for annealing ferrous workpieces for galvanizing, the method including the steps of providing sequential first, second, third and fourth furnace sections having separate furnace controls for heating lengths of elongated ferrous workpieces passed in succession in an end to end relation in each furnace section, the first and third furnace sections each having at least one inductor coil pair for heating the ferrous workpieces, controlling each of the second and fourth furnace sections to provide substantially constant furnace operating temperatures for heating a length of the ferrous workpieces when resident therein, controlling current applied to the electrical inductor coil pair of the first furnace section to provide a substantially constant exit temperature for the ferrous workpieces at the exit of the second furnace section, controlling current applied to the electrical inductor coil pair of the third furnace section to provide a substantially constant exit temperature for heating the ferrous workpieces to a temperature sufficient for annealing of the workpieces after heating by the fourth furnace section, the control of the current applied to the electrical inductor coil pair of the third furnace section being variable from an in phase relation for the applied current to the coil pair at temperatures above the Curie temperature and an out of phase relation for applied current to the coil pair at temperatures below the Curie temperature to heat the ferrous workpieces independently of the changing magnetic phenomena occurring at the Curie temperature, controlling the fourth furnace section to provide substantially constant furnace operating temperature for annealing the ferrous workpieces at a predetermined temperature, and cooling the ferrous workpieces discharged from the fourth furnace section for application of galvanizing metal.

The invention also provides a furnace for heating ferrous metal workpieces, the furnace including the combination of a plurality of pairs of sequential furnace sections for heating ferrous workpieces arranged in an end to end relation to form a continuous supply of workpieces, some of the workpieces requiring heating rates differing from workpiece to workpiece for heating to a desired furnace discharge temperature, each pair of furnace sections including a first adjustable furnace controller to control a first of the sequentially occurring pair of furnace sections for heating a preselected one of the workpieces at a heating rate different from a heating rate for another the workpieces forming the continuous supply of workpieces for discharge at correspondingly different workpiece temperatures, and a second furnace heating control a second of the sequentially occurring pair of furnace sections for maintaining a furnace operating temperature sufficiently constant to further heat the workpieces to a predetermined required temperature for discharge therefrom.

BRIEF DESCRIPTION OF THE SEVERAL VIEWS OF THE DRAWINGS

These features and advantages of the present invention as well as other will be more readily understood when the following description is read in light of the accompany drawings in which.

DETAILED DESCRIPTION OF THE INVENTION

Figure 1:
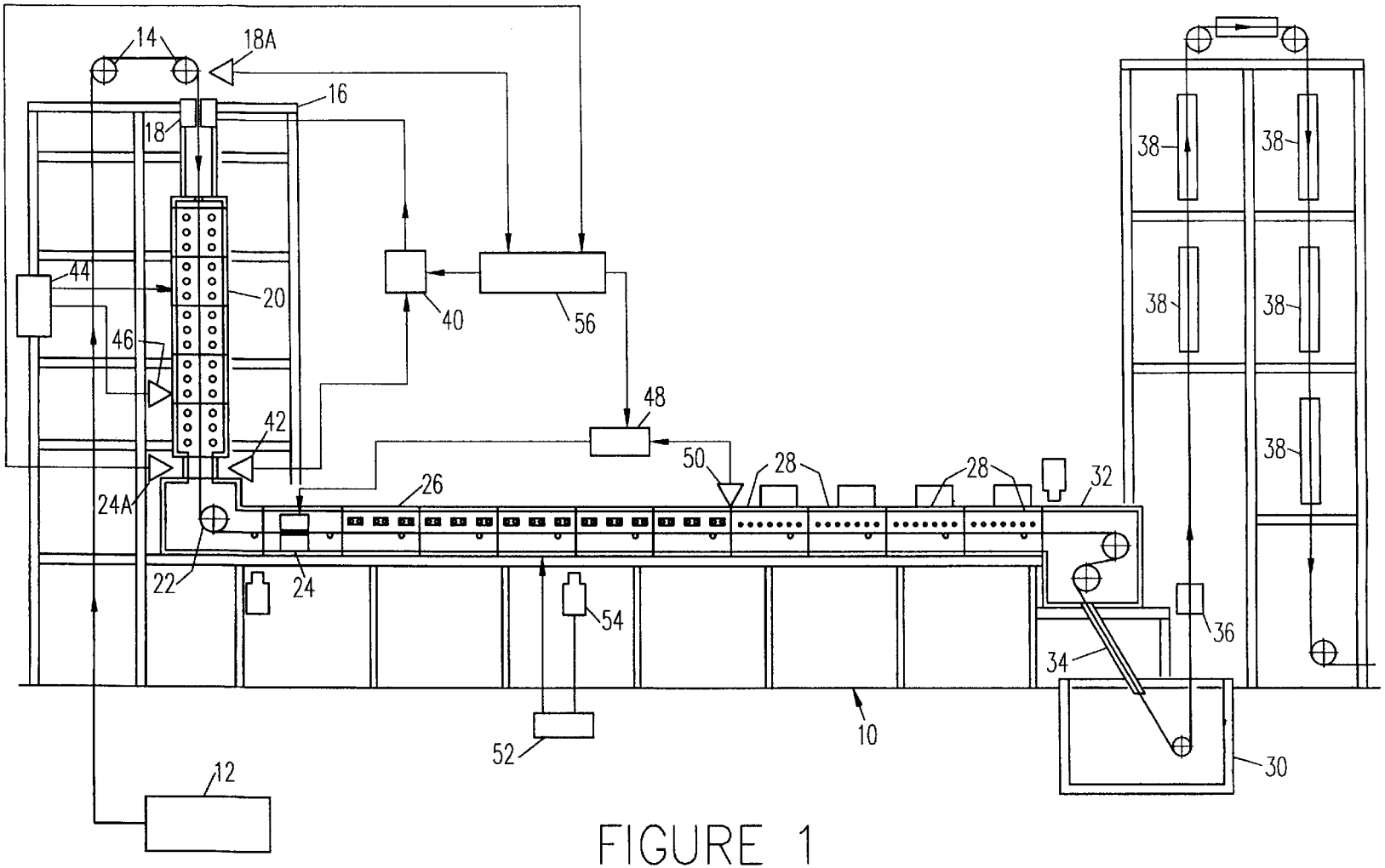
FIG. 1 is an elevational view schematically illustrating a hot dipped galvanizing line including a furnace embodying the present invention for heating a workpiece.

The hot dip galvanizing line 10 shown in FIG. 1 includes coil handling equipment 12 per se well known in the art for uncoiling coils of steel strip and welding the trailing end of one coil to the leading end to a successive coil and thereby provide a continuous supply of strip to the galvanizing line. Rollers 14 direct the strip along a path to an elevated entry site for an L-shaped furnace 16 embodying the features of the present invention. It is to be understood that the present invention is not limited to a particular placement of furnace sections to form the furnace 16. The strip passes into a first furnace section 18 where the strip is heated by longitudinal flux inductors. Below the first furnace section 18 is a second furnace section 20 which is preferably direct fossil fuel fired furnace operated under sub-stoichiometric conditions to maintain a reducing atmosphere in the second furnace section 20 and supply reducing gasses for the reducing atmosphere in the first furnace section 18 if the exit strip temperature from the first section exceeds 400° F. A guide roll 22 at the discharge end of the second furnace section directs the strip horizontally to a third furnace section 24 having induction coiled pair controlled to provide induction heating by either longitudinal flux or transverse flux or a combination of longitudinal flux and transverse flux according to the present invention. A fourth furnace section 26 preferably take the form of a radiant tube-fired furnace to provide heat soaking for the strip resident therein and completion of the heat treating cycle. Each of the furnace sections is preferably provided with high temperature refractory lining. The strip issuing from the fourth furnace section passes through consecutively arranged furnace cooling sections 28 wherein the strip temperature is reduced to a suitable temperature for entry of the strip into a bath of molten zinc or zinc alloys in a galvanizing pot 30. A special non-oxidizing atmosphere is maintained in each of the furnace sections 18, 20, 24 and 26, coiling sections 28 and a bridle section 32 which serve to propel the strip at a desired speed through a down shoot and snout 34 arranged to deliver the strip directly to the galvanizing pot. The hot dip coating on the strip emerging from the zinc pot passes between an air knife 36 to control the coating thickness on the strip before entry into the cooling sections 38. The cooling sections 38 are vertically spaced in a tower and serve to reduce the strip temperature before the strip is coiled. As the strip is discharged from the furnace 16, as an alternative to galvanizing, the strip may be cooled in an inert atmosphere and then coiled or further processed for a particular purpose.

According to the present invention, furnace section 18 incorporates one or more longitudinal flux inductors controlled by an adjustable inductor controller 40 responsive to a temperature sensor 42 such as a pyrometer located at the discharge end of the second furnace section 20 for rapidly adjusting the heating rate of the strip fed through the furnace section 18. Furnace section 20 may be constructed in any well known fashion preferably a fossil fueled direct fired furnace with open-flamed burners controlled by a controller 44 in response to a measured parameter such as a furnace operating temperature provided by a sensor 46. Controller 44 is used to maintain a reducing atmosphere in the furnace by controlling the burners to operate in a sub-stoichiometric condition to reduce any oxide formation on the strip surface and clean the strip by combustion of surface impurities such as oil or mill scale residues. Third furnace section 24 incorporates induction heating coils controlled by an adjustable furnace controller 48 for heating the length of a strip fed through the furnace at a heating rate selected and controlled by the controller 48 to produce a predetermined desired discharge temperature of the strip form the fourth furnace section 26. The discharge temperature from furnace section 26 is monitored by a temperature sensor 50 which also provides an input signal to the controller 48 for rapidly adjusting the heating rate by the third furnace section 24 to maintain the desired discharge temperature of the strip form the fourth furnace a section 26. The third furnace section is provided with an induction coil pair with the power supply to each coil in the pair selectable according to a desired phase relation between the current applied to each coil in the pair as will be discussed in greater detail hereinafter. Fourth furnace section 26 may be of any desired furnace construction preferably a radiant tube heating furnace to heat and further soak the strip. The furnace section 26 has burners for fuel controlled by a controller 52 in response to a measured parameter such as a furnace operating temperature provided by a sensor 54. An inert atmosphere is maintained in the third and fourth furnace sections 24 and 26 to prevent the formation of surface oxidation on the strip which would otherwise would rapidly occur due to the highly heated state of the strip.

A feature of the present invention provides that the furnace controllers 40 and 48 for the induction heating furnace sections 18 and 24 are responsive to a heating system controller 56 to rapidly alter the heating rate of strip due to, for example, a change to the thickness of an incoming strip as compared with the thickness of the trailing end of the departing strip from each furnace. This feature of the present invention assures the maintenance of product quality during transitions from different strip thicknesses and also during changes from different heating cycles. Controller 56 receives in one aspect of the present invention inputs from sensors 18A and 24A situated at the entrance of the first furnace section 18 and the third furnace section 24, respectively. The sensors 18A and 24A provide signals corresponding to a detected change to the leading end of strip entering the associated furnace sections. Controller 56 also receives other suitable inputs representing the change to the strip which is known to occur when detected by sensors 18A and 24A and product command signals supplied to each of the controllers 40 and 48 for accomplishing the appropriate increase or decrease to the heating rate by the induction coils of the furnace sections 18 and 24.

The present invention provides a unique combination of pairs of furnace sections sequentially arranged to heat workpieces in a reliable and fully controllable manner for assuring that the required temperature of the workpiece is obtained. In the embodiment of FIG. 1 two pairs of furnace sections are used, the first pair being furnace sections 18 and 20 and second pair being furnace sections 24 and 26. Identifying the furnace sections as pairs is based on the manner in which the furnace sections of the pair are controlled namely, the heating rate of the first section is controlled in response to a desired temperature for the workpiece discharged from the second furnace section with the further provision that the first furnace section is rapidly adjustable to alter the heating rate and the second furnace section is controlled to maintain a substantially constant furnace temperature. It is within the scope of the present invention to provide three or more such pairs of sequential furnace sections. Such a multiplicity of furnace section pairs is useful, for example, for grain-refining heat treatment for steels killed with aluminum or other grain-refining elements by two or more typically four heating and cooling cycles between room temperature and a temperature of, for example, 1500° F. The present invention may be further practiced by providing a special purpose furnace section interleaved among the pairs of furnace sections wherein the special purpose furnace section is operated independently of the furnace controls used for the pairs of furnace sections.

Figure 2:
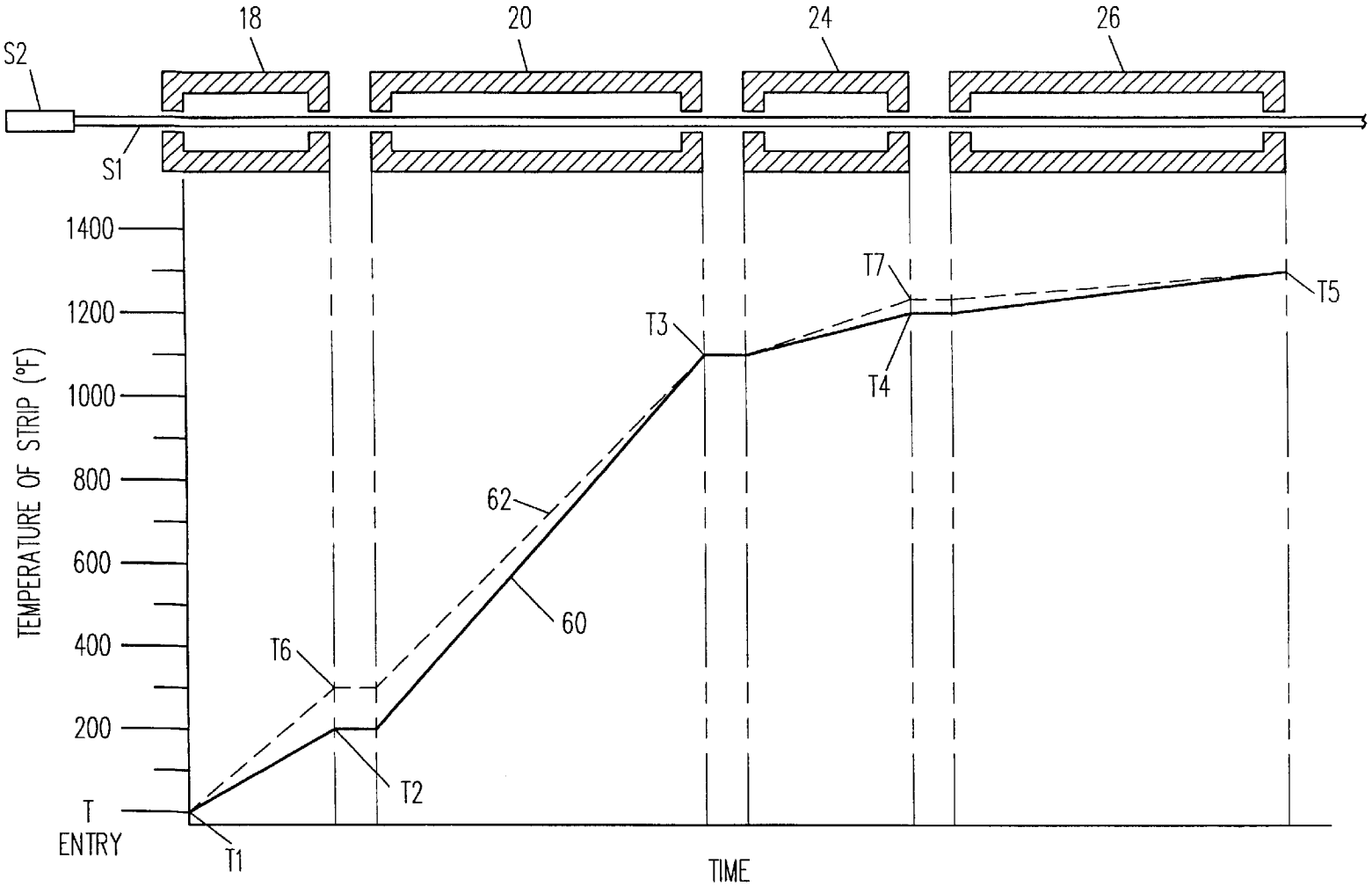
FIG. 2 is a schematic illustration of the multi section furnace shown in FIG. 1 with graph lines representing a time temperature heating profile for commercial quality annealing of metal strip.

In FIG. 2, the furnace 16 is diagrammatically illustrated by the sequential arrangement of the furnace sections 18, 20, 24 and 26 in association with time-temperature coordinates containing two curves 60 and 62 representing heating profiles of two ferrous metal workpieces S1 and S2. The workpieces are two coils of steel strip welded in an end to end relation for traveling through the furnace at the same line speed. Curve 60 represents the time-temperature relationship for the strip S1 that is thinner than the strip S2 and is represented by curve 62. The two curves 60 and 62 are part of a family of curves representing heat treating profiles for a variety of ferrous metal workpiece processing by a steel making facility. The ferrous metal workpieces may have the characteristics of different thicknesses, widths and metallurgical properties imposing the need for different heating rates from workpiece to workpiece or from groups of workpieces when forming part of a continuous supply of workpieces to the furnace 16. From curve 60, it can be seen that strip S1 enters the first furnace section 18 at ambient temperature identified by reference character T1. The induction heating coil of the furnace 18 is supplied with current preselected to heat the strip to a temperature T2 and for further heating in furnace section 20. The constant operating temperature of the furnace 20 elevates the strip temperature further to a temperature T3. The induction heating coils of the third furnace section 24 are supplied with current preselected to further heat the strip to a temperature T4 for entry in the fourth furnace section 26. The constant operating temperature of the fourth furnace section 26 elevates the temperature of the strip further to a furnace discharge temperature T5 preselected at 1350° F. to achieve desired heat treating of the strip.

The curve 62 illustrates strip S2 with same strip entry temperature as strip S1. Strip S2 is heated at an increased heating rate as compared with the heating rate for strip S1 according to the present invention by the use of the furnace controller 40 to increase the current supplied to the induction heating coil of furnace 18 to a discharged temperature T6. By increasing the heating rate by the first furnace section, the strip S2 enters the second furnace section 20 at a temperature greater than the entry temperature of strip S1. The provision of induction heating at this location in the furnace allows the selection of a specific increase to the heating rate such that the temperatures of strips S1 and S2 when discharged from furnace 20 are at same temperature T3. The furnace operating temperature of the second furnace section 20 is not changed but maintains the same constant furnace operating temperature which is sufficient to heat the thicker strip S2 to the same discharge temperature T3 as the thinner strip S1. The costs to maintain and operate furnace 20 are reduced by allowing the use of a furnace construction having a large heating capacity to accomplish large strip temperature changes and avoid the need for a rapid responsive temperature control.

The induction heating coils of the third furnace section 24 are controlled to heat the thicker strip S2 at a greater heating rate than the thinner strip S1 so that the thicker strip is more highly heated and will exit the third furnace section at a higher temperature T7 than the exit temperature of the thinner strip when heated by the third furnace section. Both the thinner and thicker strips experience different heating rates in the constant furnace operating temperature in the fourth furnace section 26 but emerge at the same temperature of 1350° F. which is selected for producing a predetermined commercial quality heat treatment. With the use of a selectable heating rate by the first furnace section 18 the thicker strip S2 and, if desired, the thinner strip S1 can be heated to a higher temperature, within the acceptable temperature range for efficient strip cleaning, for entry in the second furnace section. This strip temperature "boost" feature of the first furnace section allows a wider range of strip thickness that can be processed at the same line speed with a constant furnace operating temperature in the second and fourth furnace sections while still maintaining optimum exit temperature from the second furnace section and desired heat treating of the strip delivered from the fourth furnace section. Furthermore, the heating rate by the first furnace section can be continuously adjusted, if necessary, to keep the exit temperature of the second furnace section constant in the event a particular strip property such as thickness variation along the length of a particular coil of strip. The delivery temperature of the strip from the third furnace section is at a temperature level which allows effective power input by induction heating coils operated in a phased relation to provide transverse flux heating since the temperature level is not materially different from the Curie temperature. The term Curie temperature as used herein means the temperature of magnetic transformation below which a metal or alloy is magnetic and above which it is paramagnetic.

Figure 3:
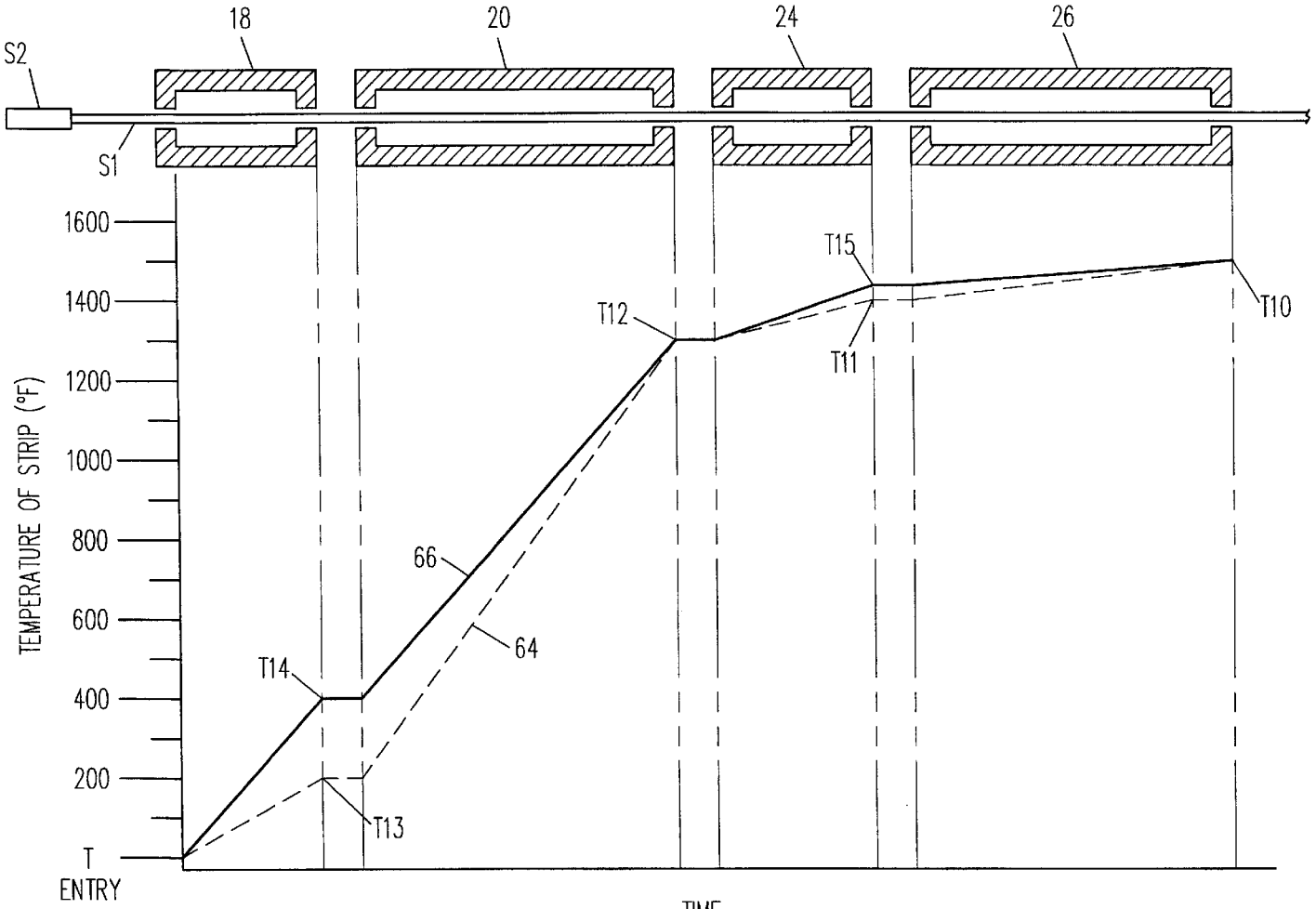
FIG. 3 is a schematic illustration of the multi section furnace shown in FIG. 1 with graph lines representing a time temperature heating profile for drawing quality annealing for metal strip.

In FIG. 3 curves 64 and 66 representing heating profiles of the same two ferrous workpieces S1 and S2 comprised of steel strip of two coils welded end to end. In the graph portion of FIGS. 2 and 3, the temperature of the strip passing between the furnace sections is shown as substantially constant although an insignificant heat loss is likely to occur. The spacing between two adjacent furnace sections is preferably thermally insulated and made short as possible to avoid heat loss. The temperature profile of FIG. 3 has the feature of heat treating the strip to a temperature T10 of 1550° F. for an annealing process to yield a drawing quality strip product. The third furnace section 24 according to the present invention is constructed and operated with induction heating coil pairs for transverse flux or a combination of transverse and longitudinal flux heating because the strip must be heated to a temperature T11 above the Curie temperature and to a temperature closely approximating the final desired temperature T10 of the strip when discharged from the fourth furnace section 26. The fourth furnace section is used to heat soak the strip which will not significantly increase the strip temperature. Under these circumstances it is required that the strip S1 enter the third furnace section at a temperature T12 close to the Curie temperature which is about 1350° F. for carbon steel strip. Furnace 20 heats the strip to the temperature T12 after initial heating of the strip in furnace 18 at a selected heating rate to an elevated temperature T13. Temperature T13 is selected to assure a strip delivery temperature T12 of about 1350° F. from furnace section 20.

Furnace 24 is operated in the transverse flux mode or a combination of transverse and longitudinal flux, as will be described in greater detail hereinafter, to produce additional heating of the strip in furnace 26 at a temperature which is slightly below the final desired annealing temperature so that the operation of the furnace 26 achieves the final temperature increase and soaking function. Strip S2 must be heated initially in furnace 18 to a higher temperature T14 because of its greater thickness as compared to strip S1 which can be accomplished with a rapid response heating rate using the controls for the induction heater coils. Furnace section 20 operates at the same constant furnace temperature to produce a strip discharge temperature T12 which is successfully achieved by the magnitude of heating in furnace section 18. Strip S2 is heated to a higher temperature T15 by furnace 24 so that upon entry into the fourth furnace section 26 the thicker strip will require a smaller temperature increase and still obtain the desired heat soaking function with the exit temperature at T10.

In order to anneal a steel strip with a drawing quality hardness, the strip must be fully annealed requiring that the strip exit temperature from the furnace 16 is above the Curie temperature of the strip. Induction heating of the strip by the third furnace section using induction coils operated for heating by longitudinal flux will efficiently heat a steel strip to a temperature below the Curie temperature as previously described in regard to FIG. 2. Induction heating by producing longitudinal flux cannot be used to heat efficiently a steel strip at temperatures above the Curie temperature of the strip. For this reason when the strip must be heated to a temperature above the Curie temperature, the temperature of the strip delivered from second furnace section is preselected at temperature that is close to the Curie temperature. First furnace section 18 is controlled to heat the strip to a temperature which is sufficient so that further heating by the second furnace section delivers the strip at the preselected temperature near the Curie temperature. The adjustable heating rate by the first furnace section can be used to supply strip at a higher or lower temperature for corresponding changes to the line speed. The adjustable heating rate by the first furnace section can be continuously adjusted, if necessary, to maintain the preselected temperature of the strip discharged from the second furnace section in the event of significant strip thickness variations occurring in a particular coil of a strip.

In addition to a longitudinal flux inductor, a separate transverse flux inductor could be installed as components of the third furnace section 24 to efficiently heat the strip from a temperature below to a temperature above the Curie temperature. However, separate longitudinal and transverse flux inductors and power supplies for the two types of inductors lengthen the third furnace section, increase the capital and operating expenses and add complexity for interface controls. To avoid these disadvantages the present invention provides an electrical inductor coil pair controlled by a dual output power supply used to adjust the electrical phase relationship between the currents in the electrical inductor coil pair to heat the strip to a temperature that is either above or below the Curie temperature of the strip.

Longitudinal flux inductors are generally formed as a solenoidal coil that surrounds the metal workpiece. An alternating current flows through the coil turns and produces a longitudinally oriented, time-variable magnetic field that induces eddy currents to circulate within the strip thickness if the strip is ferromagnetic with high permeability. The longitudinal orientation of the flux is parallel to the direction of strip travel. The eddy currents produce heat by the Joule effect. Longitudinal flux coils are not effective for nonmagnetic materials, stainless steel and ferrous workpieces at a temperature above the Curie temperature.

Transverse flux inductors are used for effective electric induction heating of nonmagnetic workpieces or ferrous workpieces at temperatures above the Curie temperature. Transverse flux inductors are formed by arranging induction coils in spaced apart locations along opposite sides of a metal workpiece such that the workpiece passes between the coils. The strip passes through induction coil pairs that create a common magnetic flux perpendicular to the face of the strip. This magnetic flux passes perpendicularly through the thickness of the strip. The induced eddy currents by transverse flux induction are circulated in the plane of the strip but not within the strip thickness. The current loop is closed along the edge of the strip.

Figure 4:
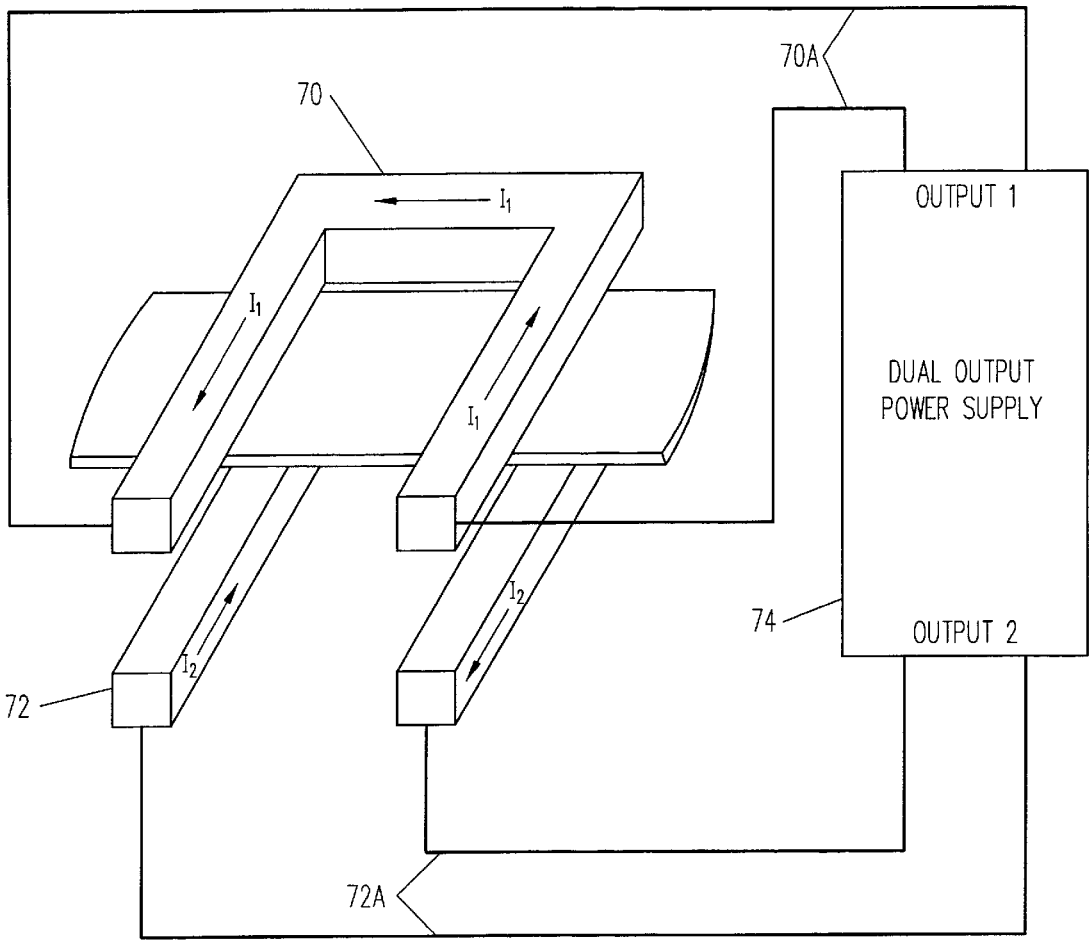
FIG. 4 is a diagrammatic illustration of an electric induction coil pair and a dual output power supply for heating strip in transverse flux, longitudinal flux, or combined flux modes according to the present invention.
Figure 4A:
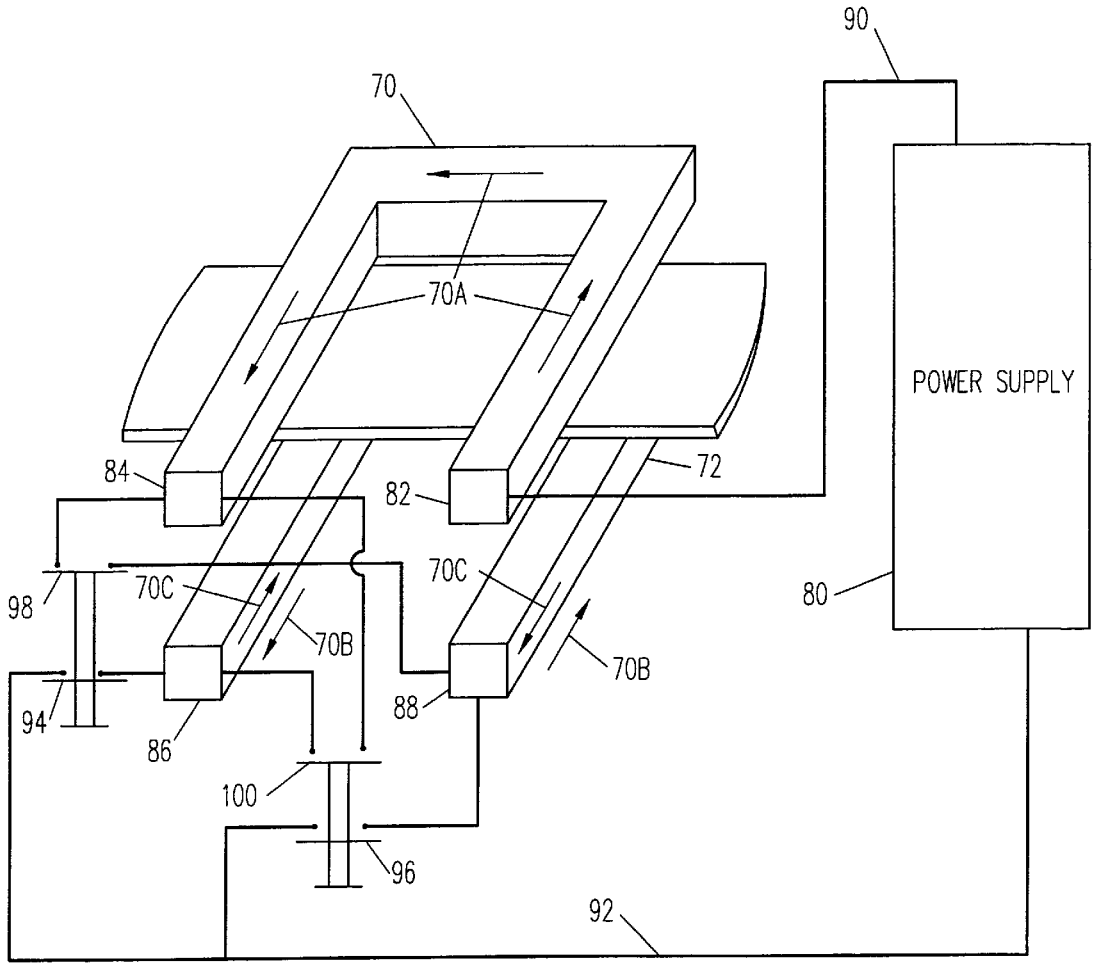
FIG. 4A is a diagrammatic illustration of an electric induction coil pair and a power supply including switching for changing between transverse flux and longitudinal flux modes of heating strip according to the present invention.

FIG. 4 illustrates an embodiment of an electric induction coil pair comprising coils 70 and 72 connected by lines 70A and 72A to a dual output power supply 74 constructed for supplying output currents at a frequency of; for example, selected at a frequency in the range of 1 to 4 kHz. The power supply includes control for adjusting the phase angle between the currents $I_1$ and $I_2$ applied to coils 70 and 72, respectively. The phase angle is preferably adjusted in the range of zero to 180 degrees. When currents $I_1$ and $I_2$ are 180 degrees out of phase, the coils 70 and 72 produce a longitudinal, relative to the elongated length of the workpiece, magnetic flux to heat the metal workpiece. Conversely, when currents $I_1$ and $I_2$ are in the same phase relation, or zero degrees out of phase, the coils 70 and 72 produce a transverse magnetic flux, relative to the elongated length of workpiece, to heat the metal workpiece. When the currents $I_1$ and $I_2$ are less than 180 degrees and greater than zero degrees out of phase a resultant magnetic flux is a combination of longitudinal and transverse flux components which will heat the workpiece FIG. 4A illustrates a single output power supply 80 connected by lines controlled by switches to switch between strip heating by transverse flux and strip heating by longitudinal flux. The inductor terminal of coil 70 are identified by reference numerals 82 and 84 and the inductor terminal of coil 72 are identified by reference numerals 86 and 88. Terminal 82 is connected to current supply line 90 of the single output power supply 80. A current supply line 92 is connected to a terminal of each of switches 94 and 96. When switch 94 is actuated, line 92 is connected with inductor terminal 86 and when switch 96 is actuated, line 92 is connected with inductor terminal 88. When switch 94 is actuated, a switch 98 is also actuated and interconnects inductor terminals 84 and 88 producing an electrical configuration resulting in the operation of a coil pair 70 and 72 for strip heating in transverse flux in which there is no phase angle difference of the current applied to coils 70 and 72. In this transverse flux heating mode, current is applied to coil 70 in the direction indicated by arrow 70A and current is applied to coil 72 in the direction indicated by arrow 70B. When switch 96 is actuated, a switch 100 is also actuated and interconnects inductor terminals 84 and 86 producing an electrical configuration resulting in the operation of a coil pair 70 and 72 for strip heating in longitudinal flux in which there is a 180° phase angle difference of the current applied to coils 70 and 72. In this longitudinal flux heating mode, current is applied to coil 70 in the direction indicated by arrow 70A and current is applied to coil 72 in the direction indicated by arrow 70C. Switches 94, 96, 98 and 100 are, per se, well known in the art and electronically controlled to always operate such that switches 94 and 98 are operated simultaneously to conduct current for transverse flux heating of the workpiece and these switches are operated to stop conducting current and when switches 96 and 100 are operated simultaneously to conduct current for longitudinal flux heating of the workpiece and vice-versa.

Figure 5:
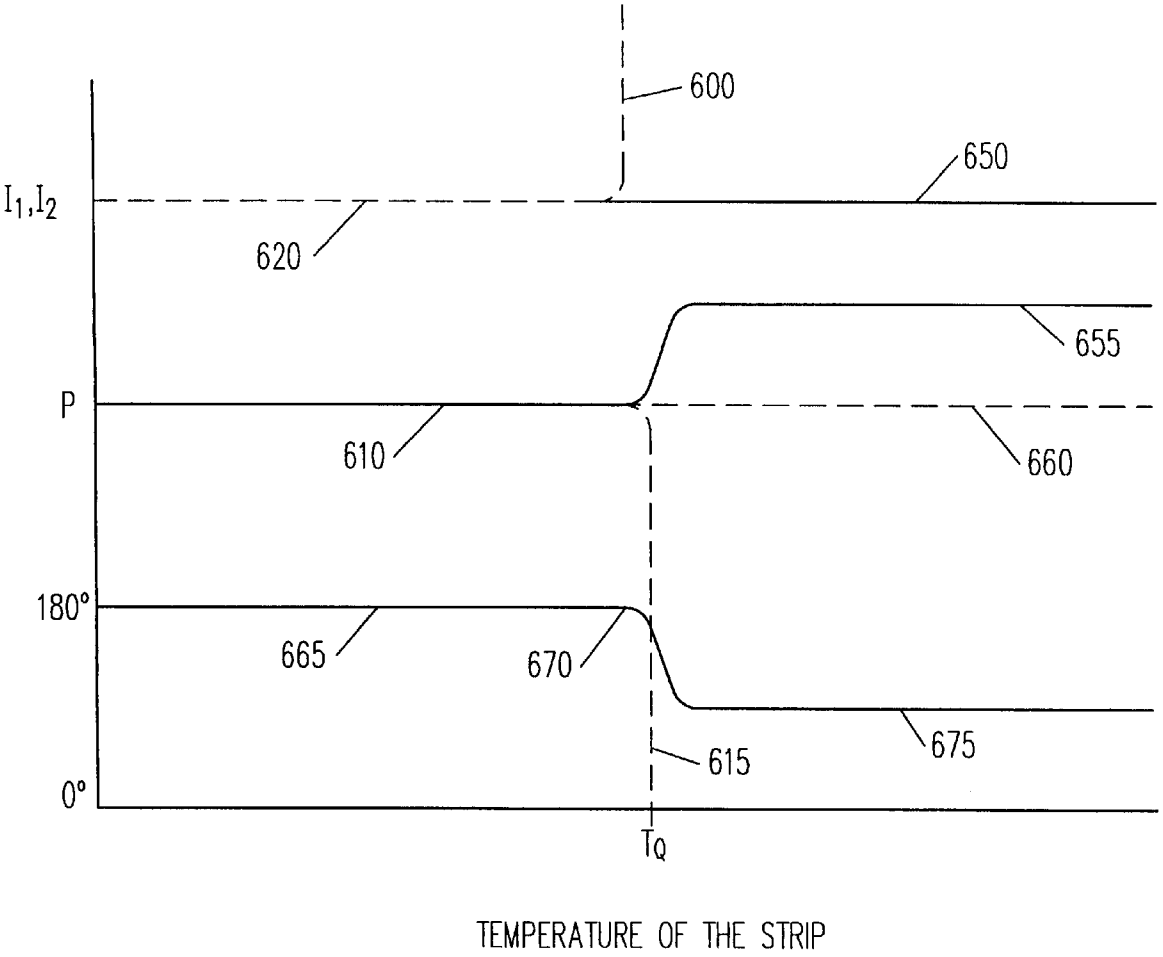
FIG. 5 is a series of graph lines representing strip temperature verses induced power in a workpiece and magnitude/phase of output current from the power supply for an induction coil pair shown in FIGS. 4 according to the present invention.

The curves in FIG. 5 further illustrate the advantage of using coils 70 and 72 with a dual output power supply 74. The y-coordinate contains plots of the power, P, induced in a workpiece from the magnetic flux created by currents $I_1$ and $I_2$ flowing through the coils; the magnitude of currents $I_1$ and $I_2$; and the phase angle between the currents $I_1$ and $I_2$. Generally, the two currents will be substantially equal in magnitude, although this is not essential. For a longitudinal flux inductor to maintain a substantially constant power level, P, when the temperature of a ferrous metal workpiece is below the Curie temperature $T_Q$ as shown by curve 610, a constant frequency of currents $I_1$ and $I_2$ are supplied to the longitudinal flux inductor coils. At the Curie temperature $T_Q$, the magnetic permeability of a ferrous workpiece rapidly drops which causes the power induced in the workpiece to drop to zero as illustrated by curve 615. At the same time, the magnitude of the output current $I_1$ and $I_2$ increases rapidly as illustrated by curve 600 which will drive the power supply for the longitudinal flux inductor into over current limits.

According to the present invention, substantially constant power levels as illustrated by the curves 610 and 660 are maintained above and below the Curie temperature by using the dual output power supply 74 to adjust the phase angle between the currents $I_1$ and $I_2$ in coils 70 and 72, respectively. Below the Curie temperature, the output currents from the two power supplies are controlled to produce $I_1$ and $I_2$ in coil pair 70 and 72 that are 180 electrical degrees out of phase (curve 665) to induce constant power (curve 610) in the workpiece. Above the Curie temperature, the phase angle difference transitions to a value less than 180 degrees (curve 675) to maintain a constant induced power (curve 660) in the workpiece. In one embodiment, the phase angle difference is reduced to approximately 40 degrees to maintain constant power in the strip above the Curie temperature. Curve 655 represents typically the increased power that occurs in a phase angle difference transition to zero degrees.

Figure 6:
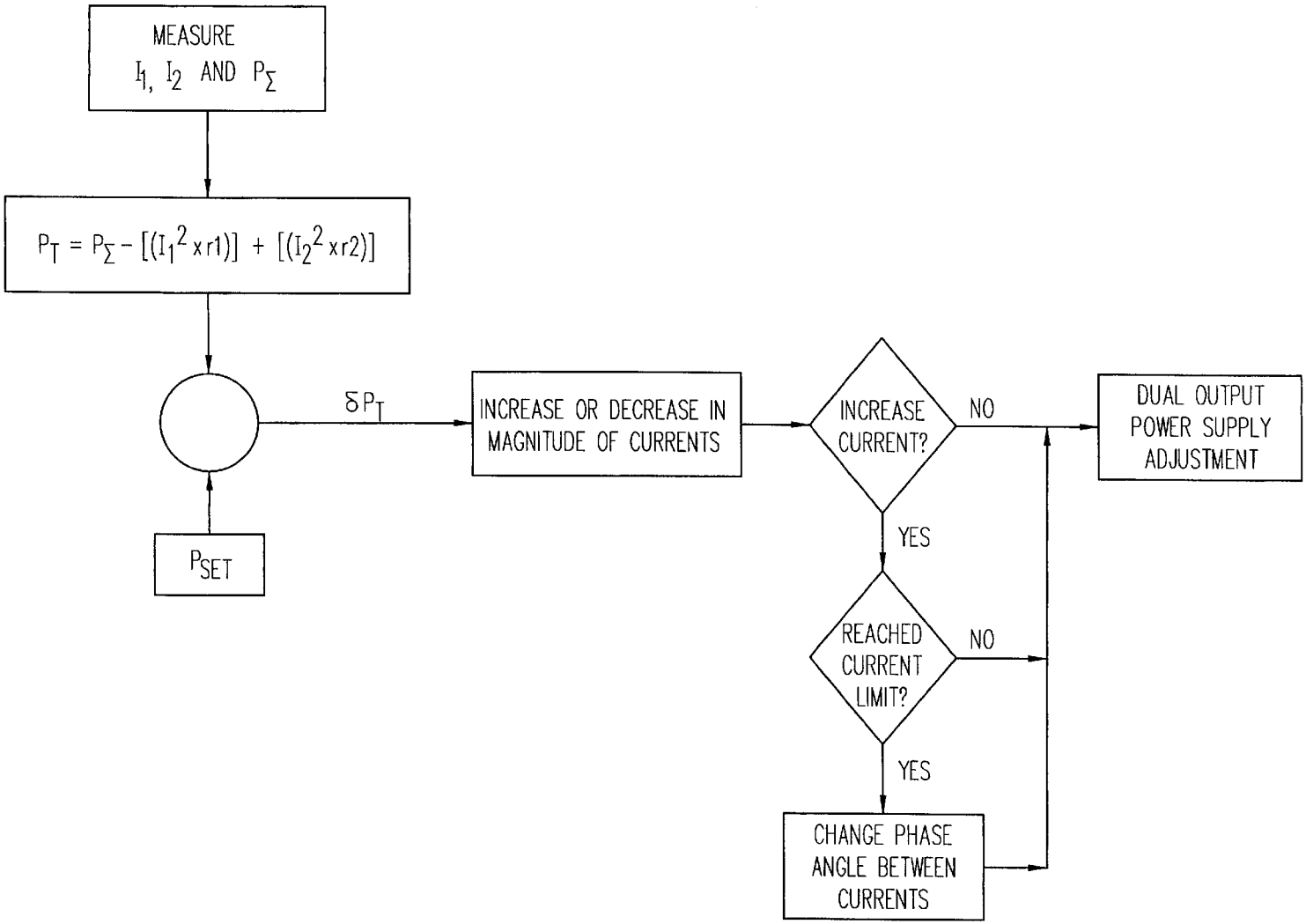
FIG. 6 is a flow diagram illustrating control logic for magnitude and phase control of currents in a coil pair according to the present invention.

FIG. 6 illustrates control logic used with coils 70 and 72 and power supply 74 to control the heating power $P_T$ induced in the strip by the magnetic fields established by currents $I_1$ and $I_2$. The magnitudes and relative phase angle of the currents can be measured by appropriate, well known measuring devices. It is assumed that the power supply is delivering electric current with a relative phase angle between $I_1$ and $I_2$ at 180 degrees operating in a mode to produce longitudinal magnetic flux by coils 70 and 72. Total power supplied to both coils can be measured. Power losses for coils 70 and 72 respectively, can be calculated by multiplying the resistive value by the square of the respective current in each coil. The resistance $r_1$ and $r_2$ of the coils 70 and 72 can be calculated by using measured values by the actual current and power applied to the coils in the absence of a strip or workpiece. The calculated value of the present $P_T$ is then equal to $[P_\Sigma-(I^2_{12}\times r_1)+(I^2_{22}\times r_2))]$. $P_{SET}$ represents the corresponding power that must be induced in the strip to achieve a predetermined exit temperature at the exit of third furnace section 24. The present $P_T$ is compared with $P_{SET}$ to establish a delta total power P that must be added to or subtracted from the present $P_T$ to heat the strip to $P_{SET}$. A determination is made as to whether the magnitudes of $I_1$ and $I_2$ have to be raised or lowered to produce a new $P_T$ that is equal to $P_{SET}$. If a decrease is requested, the outputs of the power supply 74 are reduced accordingly. If an increase in the magnitudes of $I_1$ and $I_2$ is requested, the values are checked against a preset current limit value for the power supply 74. If the requested increase in the magnitudes of $I_1$ and $I_2$ exceeds the preset current limit values, the phase angle between $I_1$ and $I_2$ is phased back until the magnitudes of $I_1$ and $I_2$ are below the preset current limit value. As previously explained, as the strip is heated above the Curie temperature, the phase angle between $I_1$ and $I_2$ will continue to phase back to maintain a fixed $P_{SET}$ for the strip. The control shown in FIG. 6 can be implemented by the inclusion of computer processing circuitry in the dual output power supply 74.

While the present invention has been described in connection with the preferred embodiments of the various figures, it is understood that other similar embodiments may be used or modifications and additions may be made to the described embodiment for performing the same function as the present invention without deviating therefrom. Therefore, the present invention should not be limited to any single embodiment, but rather con ed in breadth and scope in accordance with the recitation of the appended claims.

What is claimed is:

1. A furnace for heating ferrous metal workpieces, said furnace including the combination of:

a plurality of furnace sections including sequential first, second, third, and fourth furnace sections for heating ferrous metal workpieces arranged in an end to end relation to form a continuous supply of workpieces, some of said workpieces requiring heating rates differing from workpiece to workpiece for heating to a desired furnace discharge temperature;

a first adjustable furnace controller to control said first furnace section for heating a preselected one of said workpieces at a heating rate different from a heating rate for another said workpieces forming said continuous supply of workpieces for discharge from said first furnace section at correspondingly different workpiece temperatures;

a second furnace heating control for said second furnace section to maintain a second furnace operating temperature sufficiently constant to further heat said workpieces to a predetermined required discharge temperature;

a third adjustable furnace controller to control said third furnace section for continued heating of said workpieces, said third adjustable furnace controller controlling heating of said preselected one of said workpieces at a heating rate different from a heating rate for other of said workpieces for discharge from said third furnace section at correspondingly different workpiece temperatures; and a fourth furnace heating control operatively coupled to said fourth furnace section for maintaining a fourth furnace operating temperature to continue heating of said workpieces including said preselected one of said workpieces for discharge from said fourth furnace section at a predetermined temperature to metallurgically heat treat said continuous supply of workpieces.

2. The furnace according to claim 1 wherein said first furnace section includes at least one longitudinal flux inductor for electric induction heating of said workpieces to a temperature below the Curie temperature.

3. The furnace according to claim 2 wherein said first adjustable furnace controller includes a first electric power source operative to adjustably control heating of said workpieces by said at least one longitudinal flux inductor in said first furnace section to provides said predetermined required discharge temperature for said workpiece delivered from said second furnace section.

4. The furnace according to claim 3 wherein said third furnace section includes at least one induction coil pair for electric induction heating of said workpieces, and wherein said third adjustable furnace controller includes a second electric power source operative to adjustably control the heating of workpieces by said at least one inductor coil pair in said third furnace section to provide said substantially constant discharge temperature for said workpieces delivered from said fourth furnace section.

5. The furnace according to claim 4 wherein said second electric power source includes a controller to variably control the electrical phase relationship between currents applied to the coil pair of said at least one inductor coil pair.

6. The furnace according to claim 1 wherein said third furnace section includes at least one induction coil pair for electric induction heating of said workpieces, and a second electric power source including a controller to variably control electrical phase relationship between currents applied to the coil pair of said at least one inductor coil pair operative to adjustably control the heating of said workpieces to temperatures exceeding the Curie temperature of said workpieces.

7. The furnace according to claim 6 wherein said controller applies electrical power at a same phase angle to the respective ones of coils of said at least one inductor coil pair for applying transverse magnetic flux to heat workpieces to a temperature above the Curie temperature.

8. The furnace according to claim 6 wherein said controller applies electrical power at a phase angle difference of 180° to the respective ones of coils of said at least one inductor coil pair for applying longitudinal magnetic flux to heat workpieces to a temperature below the Curie temperature.

9. The furnace according to claim 1 further including:

a first temperature sensor for providing a first temperature measurement signal corresponding to a workpiece discharge temperature from said second furnace section, said first adjustable furnace controller being responsive to a deviation of said first temperature measurement signal from a first predetermined set point temperature signal for controlling said first furnace section to heat a workpiece for discharge from said second furnace section at a first predetermined set point temperature; and a second temperature sensor for providing a second temperature measurement signal corresponding to a workpiece discharge temperature from said fourth furnace section;

said third adjustable controller being responsive to a deviation of said second temperature measurement signal from a second predetermined set point temperature signal for controlling said third furnace section to heat a workpiece therein to a second predetermined set point temperature for further heating by said fourth furnace section such that further modification to the workpiece temperature by said fourth furnace section provides a workpiece with a predetermined temperature in response to required different heating rates by said continuous supply of workpieces;

said fourth furnace heating control controlling said fourth furnace section for maintaining a substantially constant furnace operating temperature to deliver a workpiece from said fourth furnace section at an elevated temperature controlled by said first adjustable controller and said third furnace section.

10. The furnace according to claim 1 wherein said first and second furnace sections include a reducing atmosphere, and wherein said predetermined required discharge temperature is at least 1000° F. for combusting surface contaminants and reducing surface oxides to maintain said workpieces free of surface contaminants and surface oxide.

11. The furnace according to claim 1 wherein said first and second furnace sections include a reducing atmosphere, and wherein said predetermined required discharge temperature is at least 1150° F. for combusting surface contaminants and reducing surface oxides to maintain said workpieces free of surface contaminants and surface oxide.

12. The furnace according to claim 1 wherein said first and second furnace sections include a reducing atmosphere, and wherein said predetermined required discharge temperature is at least 1350° F. for combusting surface contaminants and reducing surface oxides to maintain said workpieces free of surface contaminants and surface oxide.

13. The furnace according to claim 1 wherein said first adjustable control includes a detector responsive to workpieces entering first furnace section for providing a workpiece entry signal, said first adjustable control being responsive to said workpiece entry signal for providing a desired heating rate for the workpiece entering said first furnace section.

14. A furnace including the combination of:

a plurality of furnace sections for sequential heating elongated ferrous workpieces feed in an end-to-end relation to form a continuous supply of said workpieces, said furnace sections including an electric induction heating furnace section having at least one induction coil pair for electric induction heating of said workpieces; and an electric power source including a controller to adjust an electrical phase relationship between currents applied to the coil pair of said at least one inductor coil pair between an in phase relationship for heating said workpieces by transverse magnetic flux with respect to the direction of travel of said workpieces to temperatures exceeding the Curie temperature of the workpieces and an out of phase relationship for heating in longitudinal magnetic flux with respect to the direction of travel of said workpieces to temperatures below the Curie temperature of the workpieces.

15. The furnace according to claim 14 wherein said at least one induction coil pair includes first and second coils, and wherein said controller is adjustable to alter the electrical phase relationship between currents in said first and second coils.

16. The furnace according to claim 14 further including switches for changing said electrical phase relationship to a 180° out of phase difference.

17. The furnace according to claim 14 further including switches for changing said electrical phase relationship to an in phase with a zero difference.

18. The furnace according to claim 14 further including a dual output power supply for selecting between transverse flux and longitudinal flux heating modes.

19. The furnace according to claim 14 further including a dual output power supply for selecting a combination of transverse flux and longitudinal flux heating modes.

20. A method for heating ferrous workpieces, said method including the steps of:

feeding discrete ferrous workpieces in an end-to-end relation to form a continuous supply of ferrous workpieces, some of said ferrous workpieces having heating rates differing from workpiece to workpiece for heating to a predetermined desired furnace discharge temperature;

continuously heating said ferrous workpieces in sequential first, second, third and fourth furnace sections;

controlling said second furnace and said fourth furnace section to heat said ferrous workpieces at discrete and substantially constant heating rates;

rapidly adjusting a heating rate by said first furnace section according to said differing required heating rates to continually discharge said continuous supply of ferrous workpieces from said second heating furnace at a predetermined required discharge temperature; and rapidly adjusting a heating rate by said third furnace section according to said differing required heating rates to continually discharge said continuous supply of ferrous workpieces from said fourth heating furnace at a predetermined required discharge temperature.

21. The method according to claim 20 wherein said predetermined required discharge temperature of the continuous supply of ferrous workpieces from said second furnace section by said step of rapidly adjusting the heating rate by said first furnace section is selected to insure desired cleaning of surface contaminants on said ferrous workpieces, and wherein said step of rapidly adjusting a heating rate of ferrous workpieces by said third furnace section and heating at a substantially constant heating rate in said fourth furnace section produces desired annealing of ferrous workpieces discharged from the fourth heating furnace.

22. The method according to claim 20 wherein said step of rapidly adjusting a heating rate by said third furnace section includes adjusting an electrical phase relationship between currents applied to the coil pair of at least one inductor coil pair between an in phase relationship for heating said ferrous workpieces by transverse magnetic flux with respect to the elongated length thereof to temperatures above the Curie temperature of the workpiece and an out of phase relationship for heating by longitudinal magnetic flux with respect to the extended length of said ferrous workpieces to temperatures below the Curie temperature of the workpiece.

23. The method according to claim 20 including the further step of controlling the supply of current to said coil pair to produce heating of said ferrous workpieces by a combination of transverse and longitudinal flux.

24. The method according to claim 20 including the further step of switching the supply of current to said coil pair to produce heating of said ferrous workpieces by either transverse or longitudinal flux.

25. The method according to claim 20 including the further step of detecting a transition from one workpiece to another establishing said differing required heating rates for said steps of rapidly adjusting the heating rate by said first furnace section and said third furnace section.

26. The method according to claim 20 wherein said steps of rapidly adjusting a heating rate by said first furnace section and said step of rapidly adjusting a heating rate by said third furnace section includes adjusting electrical power applied to a coil pair of at least one inductor coil pair for each of said first and third furnace sections.

27. The method according to claim 20 including the further step of advancing said ferrous workpieces through said first, second, third and fourth furnace sections at a substantially constant rate of supplying travel.

28. The method according to claim 20 including the further step of adjusting the speed of advancement by ferrous workpieces responsive to changes to dimensions and product grade to minimize defective heat treated product between different workpiece grades fed in an end-to-end relation in said plurality of furnace sections.

29. The method according to claim 20 including the further step of controlling operation of said first furnace section to clean surface contaminants in a non oxidizing atmosphere and maintain the ferrous workpieces free of surface oxide in said second section.

30. A method for supplying heated ferrous workpieces for galvanizing, said method including the steps of:

providing sequential first, second, third and fourth furnace sections having separate furnace controls for heating lengths of elongated ferrous workpieces passed in succession in an end to end relation in each furnace section, said first and third furnace sections each having at least one inductor coil pair for heating said ferrous workpieces;

controlling each of said second and fourth furnace sections to provide substantially constant furnace operating temperatures for heating a length of said ferrous workpieces when resident therein;

controlling current applied to the electrical inductor coil pair of said first furnace section to provide a substantially constant exit temperature for said ferrous workpieces at the exit of said second furnace section;

controlling current applied to the electrical inductor coil pair of said third furnace section to provide a substantially constant exit temperature for said ferrous workpieces at the exit of said fourth furnace section, the control of the current applied to the electrical inductor coil pair of said third furnace section being variable from an in phase relation for the applied current to the coil pair at temperatures above the Curie temperature and an out of phase relation for applied current to the coil pair at temperatures below the Curie temperature to heat said ferrous workpieces independently of the Curie temperature; and cooling the ferrous workpieces discharged from said fourth furnace section to a predetermined temperature for the application of galvanizing.

31. The method according to claim 30 including the further steps of:

controlling operation of said second furnace section to maintain a reducing atmosphere therein for cleaning surface contaminants and maintaining the ferrous workpieces free of surface oxide; and maintaining a non oxidizing atmosphere in said third and fourth furnace sections and during said step of cooling the ferrous workpieces.

32. A method for annealing ferrous workpieces for galvanizing, said method including the steps of:

providing sequential first, second, third and fourth furnace sections having separate furnace controls for heating lengths of elongated ferrous workpieces passed in succession in an end to end relation in each furnace section, said first and third furnace sections each having at least one inductor coil pair for heating said ferrous workpieces;

controlling each of said second and fourth furnace sections to provide substantially constant furnace operating temperatures for heating a length of said ferrous workpieces when resident therein;

controlling current applied to the electrical inductor coil pair of said first furnace section to provide a substantially constant exit temperature for said ferrous workpieces at the exit of said second furnace section;

controlling current applied to the electrical inductor coil pair of said third furnace section to provide a substantially constant exit temperature for heating said ferrous workpieces to a temperature sufficient to effect annealing of the workpieces after heating by said fourth furnace section, the control of the current applied to the electrical inductor coil pair of said third furnace section being variable from an in phase relation for the applied current to the coil pair at temperatures above the Curie temperature and an out of phase relation for applied current to the coil pair at temperatures below the Curie temperature to heat said ferrous workpieces independently of the Curie temperature;

controlling said fourth furnace section to provide substantially constant furnace operating temperature for annealing said ferrous workpieces at a predetermined temperature; and cooling the ferrous workpieces discharged from said fourth furnace section for application of galvanizing metal.

33. The method according to claim 32 wherein said step of controlling current includes switching the supply of current to said coil pair to establish an in phase relation and an out of phase relation of the applied current.

34. The method according to claim 32 wherein said step of controlling current includes controlling the supply of current to said coiled pair to produce a combination of transverse flux and longitudinal flux for heating said ferrous workpieces.

35. The method according to claim 32 including the further steps of:

controlling operation of said second furnace section to maintain a reducing atmosphere therein for cleaning surface contaminants and maintaining the ferrous workpiece free of surface oxide; and maintaining a non oxidizing atmosphere in said third and fourth furnace sections and during said step of cooling the ferrous workpieces.

36. A furnace for heating ferrous metal workpieces, said furnace including the combination of:

a plurality of pairs of sequential furnace sections for heating ferrous workpieces arranged in an end to end relation to form a continuous supply of workpieces, some of said workpieces requiring heating rates differing from workpiece to workpiece for heating to a desired furnace discharge temperature, each pair of furnace sections including:

a first adjustable furnace controller to control a first of the sequentially occurring pair of furnace sections for heating a preselected one of said workpieces at a heating rate different from a heating rate for another said workpieces forming said continuous supply of workpieces for discharge at correspondingly different workpiece temperatures; and a second furnace heating control a second of the sequentially occurring pair of furnace sections for maintaining a furnace operating temperature sufficiently constant to further heat said workpieces to a predetermined required temperature for discharge therefrom.

37. The furnace according to claim 36 wherein a first furnace section of each pair of sequential furnace sections includes electrical induction heater and wherein said first adjustable furnace controller for each of said plurality of pairs of sequential furnace sections includes a control for heating workpieces at different heating rates, and wherein a second furnace section of each pair of sequential furnace sections includes workpiece heaters controlled by said second furnace heating control for maintaining a substantially constant operating temperature therein.

38. The furnace according to claim 36 herein said plurality of pairs of sequential furnace sections include at least three pairs of furnace sections.

39. The furnace according to claim 36 further including a cooling section having an inert atmosphere therein for reducing the temperature of said workpieces delivered from the last furnace section of said plurality of pairs of sequential furnace sections.

40. The furnace according to claim 36 further including an independently operable furnace section arranged between one of said pairs of sequential furnace sections for heating said workpieces under independent control from said pairs of sequential furnace sections.

* * * * *